United States Patent [19]

Hiraga et al.

[11] Patent Number: 4,753,583

[45] Date of Patent: Jun. 28, 1988

[54] SCROLL TYPE FLUID COMPRESSOR WITH HIGH STRENGTH SEALING ELEMENT

[75] Inventors: Masaharu Hiraga, Honjo; Tamotsu Daikohara, Shin, both of Japan

[73] Assignee: Sanden Corporation, Gunma, Japan

[21] Appl. No.: 758,971

[22] Filed: Jul. 25, 1985

[30] Foreign Application Priority Data

Jul. 25, 1984 [JP] Japan ..... 59-154686

[51] Int. Cl.[4] ..... F04C 18/04; F04C 27/00

[52] U.S. Cl. ..... 418/55; 418/142; 277/204

[58] Field of Search ..... 418/55, 142; 277/204

[56] References Cited

U.S. PATENT DOCUMENTS

| | | | |
|---|---|---|---|
| 927,781 | 7/1909 | Farrow, Jr. | 418/142 |
| 4,199,308 | 4/1980 | McCullough | 418/55 |
| 4,411,605 | 10/1983 | Sauls | 277/204 |
| 4,437,820 | 3/1984 | Terauchi et al. | 277/204 |
| 4,453,899 | 6/1984 | Hiraga et al. | 418/55 |
| 4,462,771 | 7/1984 | Teegarden | 418/142 |
| 4,547,138 | 10/1985 | Mabe et al. | 418/55 |

FOREIGN PATENT DOCUMENTS

| | | | |
|---|---|---|---|
| 55-37515 | 3/1980 | Japan | 418/55 |

*Primary Examiner*—John J. Vrablik

*Attorney, Agent, or Firm*—Banner, Birch, McKie & Beckett

[57] ABSTRACT

A scroll type fluid compressor including a housing, a pair of scroll elements each comprising an end plate and a spiral wrap means projecting from one surface of the end plate. Both wrap means are interfitted to make a plurality of line contacts and are formed with a groove on the end surface of each wrap means which receives a seal element. Each groove is formed with its center line inward of the center line of its respective spiral wrap. This construction prevents the walls of the groove from prematurely deteriorating and causing attendant destruction of the scroll elements.

4 Claims, 4 Drawing Sheets

SCROLL TYPE FLUID COMPRESSOR WITH HIGH STRENGTH SEALING ELEMENT

BACKGROUND OF THE INVENTION

The present invention relates generally to the field of fluid displacement apparatus, and more particularly, is directed to improvements in scroll type fluid compressors.

Scroll type fluid displacements apparatus are well known in the prior art. For example, U.S. Pat. No. 801,182 issued to Creux discloses such a device which includes two scrolls each having a circular end plate and a spiroidal or involute spiral element. The scrolls are maintained angularly and radially offset so that both spiral elements interfit to make a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets changes. Since the volume of the fluid pockets increases or decreases dependent on the direction of the orbital motion, a scroll type fluid displacement apparatus may be used to compress, expand or pump fluids.

An orbiting scroll element 1 and a fixed scroll element 2 are shown interfitted in FIG. 1. Because the scroll elements are angularly and radially offset, fluid pockets 3 are formed between respective side walls of the scroll elements. As scroll element 1 is orbited about fixed scroll element 2 with a radius 0—0'; the volume of fluid pockets 3 is gradually decreased. FIG. 1(*b*) illustrates the size of fluid pockets 3 after the scroll elements have been rotated 90 degrees from the position shown in FIG. 1(*a*). FIGS. 1(*c*) and 1(*d*) show the corresponding size of fluid pockets 3 after orbiting scroll element 1 has been rotated 180° and 270°, respectively. By the time orbiting scroll element 1 has been rotated 360°, fluid pockets 3 have merged at their respective center 0 and 0' as shown in FIG. 1(*a*). Also by this time, a new set of fluid pockets 3 have formed and taken in fluid for compression during the next orbit of orbiting scroll 1. Compressed fluid at the center of the interfitted scroll elements is discharged through a port as indicated by reference No. 5 in FIG. 1(*c*).

In a scroll type compressor as described above, fluid is compressed by reducing the volume of the fluid pockets as the orbiting scroll rotates about the fixed scroll. The fluid pockets are formed by the curved surfaces of each element coming into contact. If the scroll elements are precisely constructed, sufficient line contacts can be formed to seal the fluid pockets by using a bushing as disclosed in Japanese Patent Publication No. 58-19875. The seal which is formed between the axial end surface of one scroll element and the surface of the end plate of the other scroll element is achieved by grooves which are formed on the end surface of each of the scroll elements. Seal members are disposed in the grooves to seal the scroll elements. The grooves are usually formed so that their center line corresponds to the center line of the scroll elements so that the groove at the center portion of the scroll elements correspond to the involute of the scroll element.

During operation of the scrolls to compress fluid, the pressure along the outer wall of the above mentioned groove is greatly increased. This pressure F can be expressed by the equation $F=(P1-P2)\times L1\times L2$ where:

P1 = the pressure at the center portion of scroll elements.

P2 = the pressure at the intermediate chamber of the scroll elements.

L1 = is the height of the groove.

L2 = is the length of the groove.

The exertion of such a force along the walls of the grooves, particularly the outside walls, leads to premature deterioration of the grooves and ultimate destruction of the scroll elements.

Moreover, because the seal element within the groove is in tight contact against the end plate of the opposite scroll element and moves slightly with it in response to the relative movement of the scroll elements, there is additional frictional contact force exerted on the inside and outside walls of the groove during the orbital motion of the orbiting scroll element. Thus, the outside wall of the groove along one half of each scroll element is pushed toward the outside and the inside wall of the groove along the other half of the scroll element is pushed toward the inside. The direction of the force against the outside and inside walls of the groove continuously changes due to the relative orbital motion of the scroll elements. Since the outside wall of the groove thus receives the above mentioned fluid pressure F and the frictional contact force, the outside wall is especially susceptible to deterioration.

SUMMARY OF THE INVENTION

It is therefore the overall object of the present invention to provide a scroll type fluid compressor which is more durable and reliable than such compressors known in the prior art.

It is a specific object of the present invention to provide a scroll type compressor wherein the scroll elements are efficiently sealed and are not susceptible to premature deterioration.

It is a further object of the present invention to provide a scroll type fluid compressor with an improved sealing element which can withstand substantial pressure without premature deterioration.

These and other objects of the present invention are achieved by providing a scroll type fluid compressor which includes a first and second scroll elements with respective first and second end plates with wrap elements extending therefrom. Each wrap has a groove formed on the end opposite its end plate. Seal elements are located in each respective groove. The grooves are formed so that the center line of the groove is inward of the center line of the respective wrap.

Further objects, features and other aspects of the present invention will be understood from the following detailed description of the preferred embodiments with reference to the attached drawings.

DETAILED DESCRIPTION OF THE INVENTION

Figure 1A:
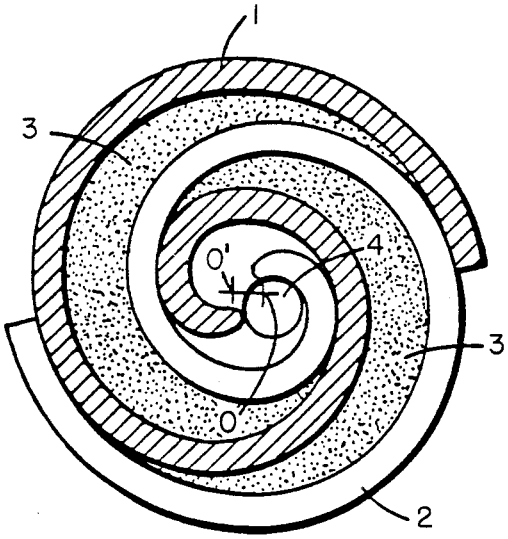
FIGS. 1(*a*) through (*d*) are views illustrating how fluid is compressed in a scroll type fluid compressor.
Figure 1B:
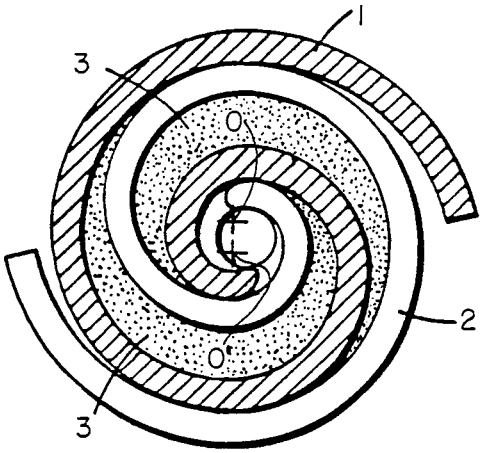
Figure 1C:
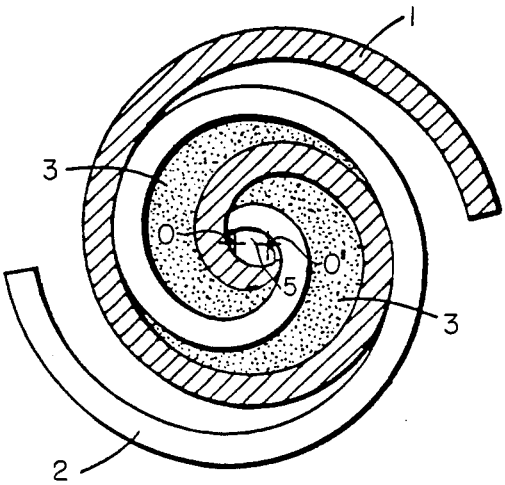
Figure 1D:
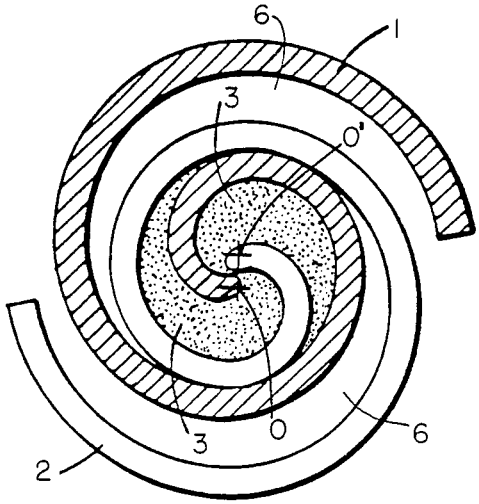
Figure 2:
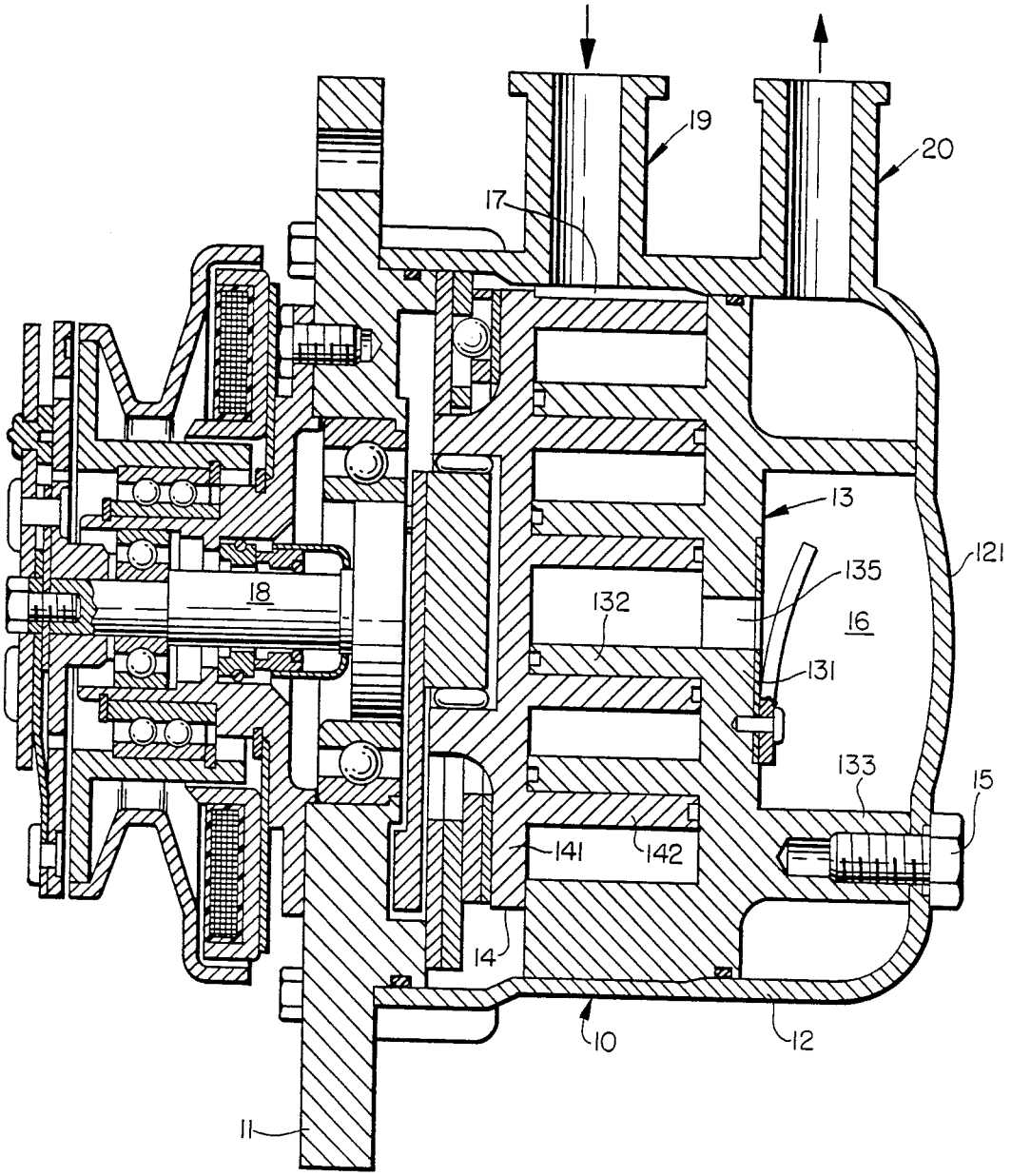
FIG. 2 is a vertical cross-sectional view of a scroll type fluid compressor in accordance with the present invention.

With reference to FIG. 2, there is shown a scroll type fluid compressor having a compressor housing which is comprised of a front end plate 11 and a cup shaped casing 12. A fixed scroll 13 and an orbiting scroll 14 are placed in housing 10. Fixed scroll 13 includes an end plate 131, a scroll element 132 which is formed on one surface of end plate 131 and a projecting portion 133 which is formed on the other surface of end plate 131. Projecting portion 133 is fixed on the inner wall of a bottom portion 121 of cup shaped casing 12 by a bolt 15 which penetrates through cup shaped casing 12. End plate 131 of fixed scroll 13, which is secured in cup shaped casing 12, divides the inner space of cup shaped casing 12 into a discharge chamber and suction chamber due to the sealing between the outer surface of end plate 131 and the inner surface or wall of cup shaped casing 12.

Orbiting scroll 14 includes an end plate 141 and a scroll element 142 which is formed on one surface of end plate 141. Scroll element 142 is combined with scroll element 132 of fixed scroll 13 to form two interfitted scroll elements as shown in FIGS. 1(*a*) through (*d*). Orbiting scroll 14 is coupled to a main shaft 18 which is supported by front end plate 11 for rotating orbiting scroll 14 about fixed scroll 13 in a manner known in the prior art.

When orbiting scroll 14 is rotated, fluid, which flows from suction port 19 formed on cup shaped casing 12 to a suction chamber 17 in housing 10, is drawn into the fluid pockets formed between scroll elements 132 and 142 as orbiting scroll 14 rotates. The fluid is continuously compressed toward the center of the scroll elements. Compressed fluid at the center of the elements is forced to a discharge chamber 16 through a discharge hole 135 formed in end plate 131 of fixed scroll 13. The compressed fluid is discharged to the outside of housing 10 through a discharge port 20.

Figure 3:
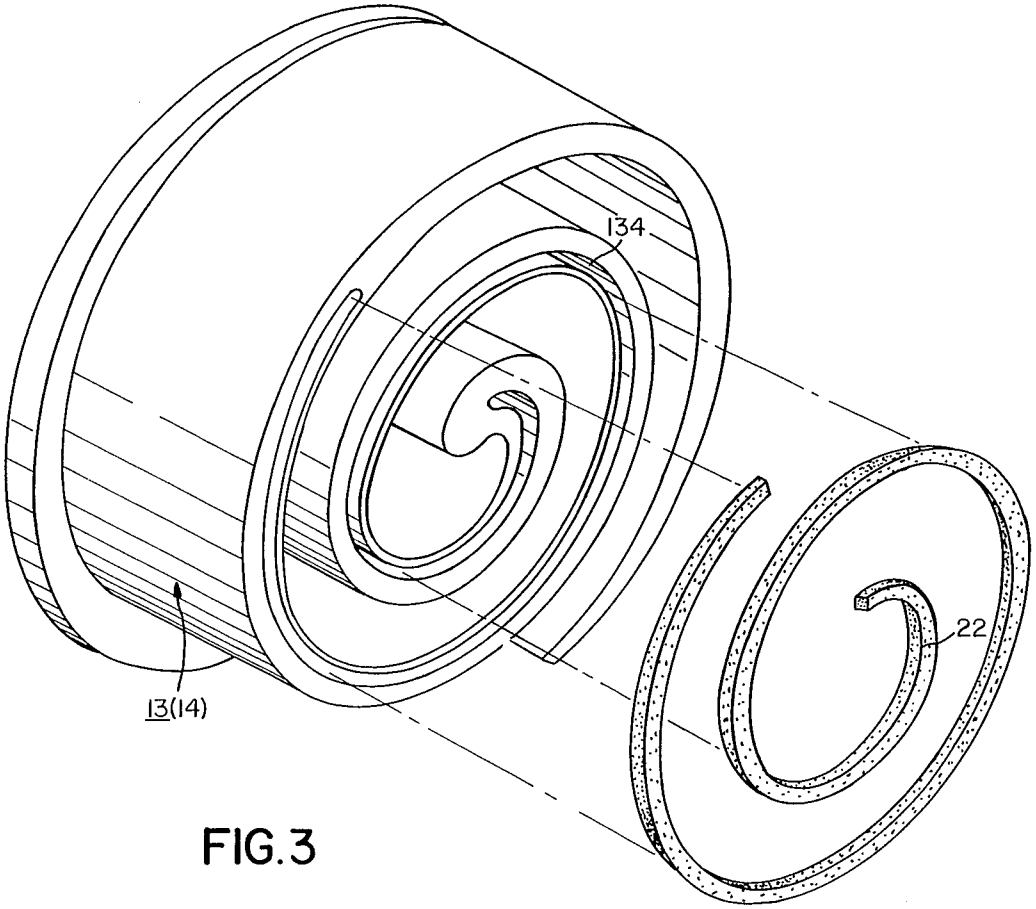
FIG. 3 is a perspective view illustrating the structure of one of the scroll elements shown in FIG. 2 and its seal element.
Figure 4:
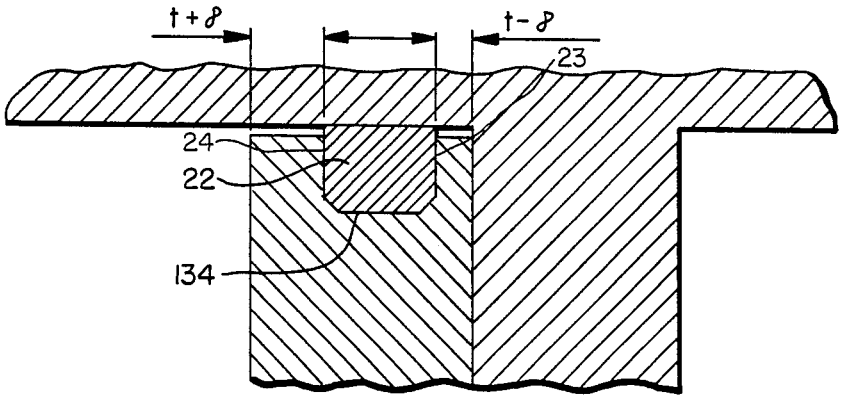
FIG. 4 is a cross-sectional view illustrating the structure of the seal member at the border portion of the fluid pockets of the scroll type fluid compressor shown in FIG. 2.
Figure 5A:
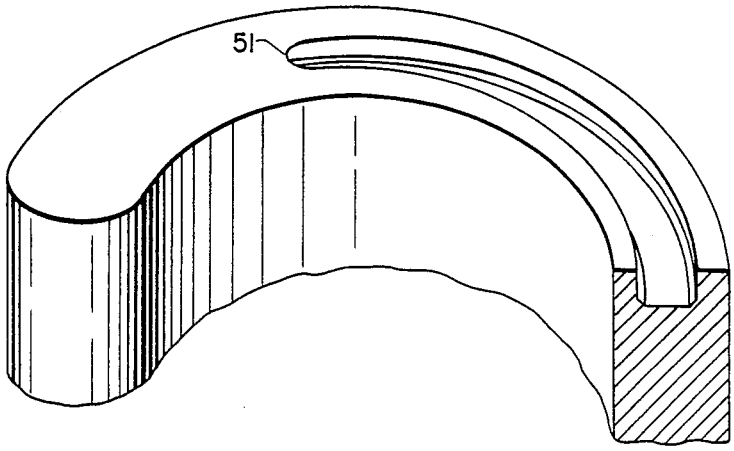
FIGS. 5A and 5B are perspective views illustrating the end portions of the grooves of the scroll elements shown in FIG. 1.
Figure 5B:
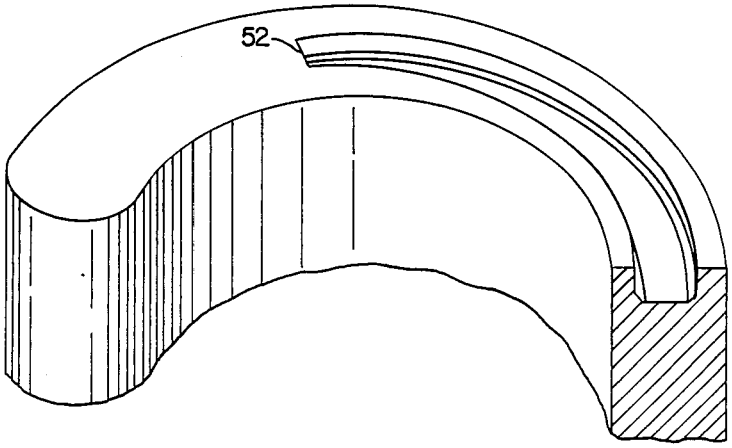

As shown in FIGS. 3 and 4, a groove 134 is formed on the axial end surface of scroll elements 132 and 142 which projects from end plate 131 and 141 of fixed scroll 13 and orbiting scroll 14, respectively. Each groove extends along the spiral of the scroll element and, as shown in FIG. 4, has an inside wall 23 and an outside wall 24. Outside wall 24 has a wall thickness of T+8 and inside wall 23 has a wall thickness of wall T−8, as shown in FIG. 4. 8 is a value determined by the thicknes of the wraps. The groove is also formed with a slant 52 on its longitudinal end as shown in FIG. 5B or a curve 51 on the end as shown in FIG. 5A. A seal element 22, shown in FIG. 3, is inserted into each groove. The cross-sectional shape of seal element 22 is the same as that of the groove. It has been discovered that forming the grooves in the above described manner greatly increases their strength since the thickness of the side walls of the grooves is greater where the greater pressure is present.

This invention has been described in detail in connection with a preferred embodiment, but this embodiment is an example only and the invention is not restricted thereto. It will be easily understood, by those skilled in the art that other variations and modifications can be easily made within the scope of the appended claims.

We claim:

1. In a scroll-type fluid compressor including a housing, a pair of scroll elements, one of said scroll elements being fixedly disposed relative to said housing and having an endplate from which a first spiral wrap extends into the interior of said housing and the other scroll element being movably disposed for non-rotative orbital movement within the interior of said housing and having an endplate from which a second spiral wrap extends, said first and second wraps interfitting in an annular and radial offset to make a plurality of line contacts to define at least one pair of sealed-off fluid pockets and drive means operatively connected to said other scroll element to effect the orbital motion of said other scroll element and said line contacts, said first and second wraps having a respective end surface, the improvement comprising:

a groove having a longitudinal end portion and an inside wall and an outside wall being formed on said end surface of each said first and second wraps to seal said wraps, said inside wall and said outside wall of each groove being integrally formed from each respective said first and second wraps, the center line of each said groove being inward of the center line of the respective said first and second wraps;

wherein each said groove includes a seal element inserted within said groove.

2. In a scroll-type fluid compressor as claimed in claim 1 wherein the improvement further comprises said outside wall having a first thickness and said inside wall having a second thickness, wherein said first thickness is greater than said second thickness.

3. The scroll type fluid compressor of claim 1 wherein the end portion of said groove is round in shape.

4. The scroll type fluid compressor of claim 1 wherein the end portion of said groove is slanted.

* * * * *